United States Patent [19]

Hess

[11] 4,353,176

[45] Oct. 12, 1982

[54] SNOW REMOVAL DEVICE WITH GAS BURNER HEATING CHAMBER

[76] Inventor: Georgia E. Hess, 910 N. Madison, Benton, Ill. 62812

[21] Appl. No.: 231,622

[22] Filed: Feb. 5, 1981

[51] Int. Cl.[3] ..... E01H 5/10

[52] U.S. Cl. ..... 37/228; 126/343.5 R

[58] Field of Search ..... 37/12; 126/271.1, 271.2 R, 126/271.2 C, 343.5 R, 343.5 A

[56] References Cited

U.S. PATENT DOCUMENTS

| | | | |
|---|---|---|---|
| 1,718,360 | 6/1929 | Kaczorowski | 37/12 |
| 2,104,363 | 1/1938 | Devlin | 37/12 |
| 2,471,733 | 5/1949 | Fiduccia | 37/12 |
| 3,036,391 | 5/1962 | Kemp | 37/12 |
| 3,066,428 | 12/1962 | Raiti | 37/12 |
| 3,155,089 | 11/1964 | Hoyt | 37/12 |
| 3,309,798 | 3/1967 | Devlin et al. | 37/12 |
| 3,353,286 | 11/1967 | Marus | 37/12 |
| 3,464,128 | 9/1969 | Kricuovich | 37/12 |
| 3,619,918 | 11/1971 | Morin | 37/12 |
| 4,071,966 | 2/1978 | Cohen | 37/12 |

FOREIGN PATENT DOCUMENTS

| | | | |
|---|---|---|---|
| 689055 | 6/1964 | Canada | 37/12 |
| 632796 | 11/1978 | U.S.S.R. | 37/12 |

*Primary Examiner*—E. H. Eickholt

*Attorney, Agent, or Firm*—Robert D. Farkas

[57] ABSTRACT

A snow removal device includes a truck unit having a forward cab portion and a rear storage portion. An elongated V-shaped container is disposed in the rear storage portion, wherein the container has a curved base, a pair of upwardly extending end walls, and the container is pitched downwardly from a front to a rear of the storage unit. A mechanism is included for injecting the snow and ice into the container as well as a heating assembly disposed in the storage portion for melting the snow and ice for discharge through the gate valve.

5 Claims, 4 Drawing Figures

SNOW REMOVAL DEVICE WITH GAS BURNER HEATING CHAMBER

BACKGROUND OF THE INVENTION

A number of U.S. patents relate to variously designed snow removal devices, but these devices are non-related to the improved snow removal device of my present instant invention. These U.S. Pat. Nos. are: 3,309,798 to Devlin; 3,333,354 to Kirshenblat; 3,074,191 to Zierak; and 3,456,368 to Jacques.

SUMMARY OF THE INVENTION

My present invention relates to a unique and novel snow removal device.

An object of my present invention is to provide a portable snow removal device capable of removing snow from the ground, melting the snow and discharging the melted snow into a sewer.

Briefly, my present invention includes a truck unit having a forward cab portion and a rear storage portion. An elongated V-shaped container is disposed in the rear storage portion, wherein the container has a curved base, a pair of upwardly extending end walls and the container is slanted downwardly from a front to a rear of the storage portion. A mechanism is provided for injecting snow and ice into the container. A gate valve is disposed in the rear portion, wherein a connecting pipe communicates between the container and the gate valve. A heating assembly disposed in the storage portion melts the snow and ice in the container which is ejected from the container through the gate valve.

BRIEF DESCRIPTION OF THE DRAWING

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
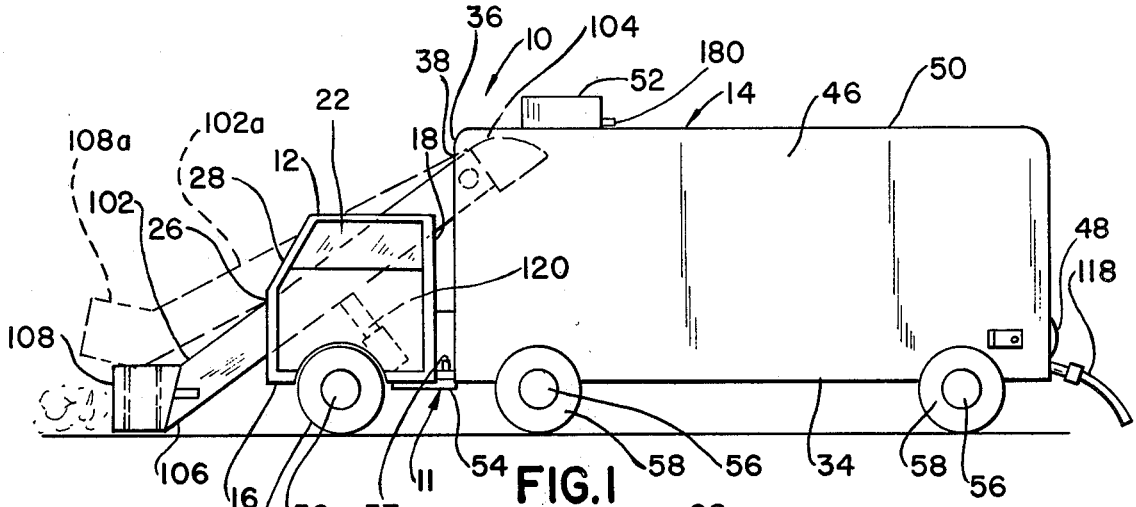
FIG. 1 illustrates a side view of a snow removal device.
Figure 2:
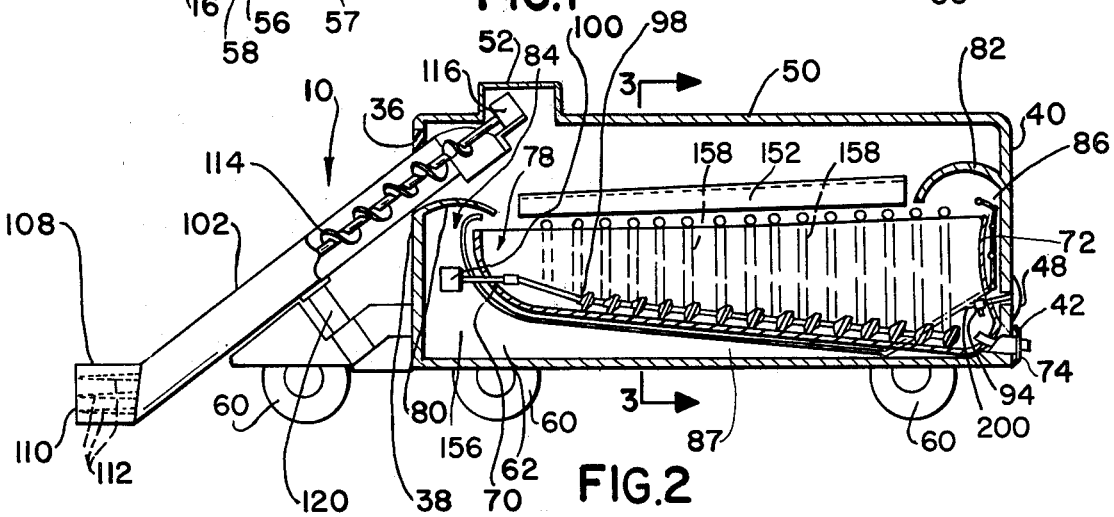
FIG. 2 illustrates a side cross section view of the device.
Figure 3:
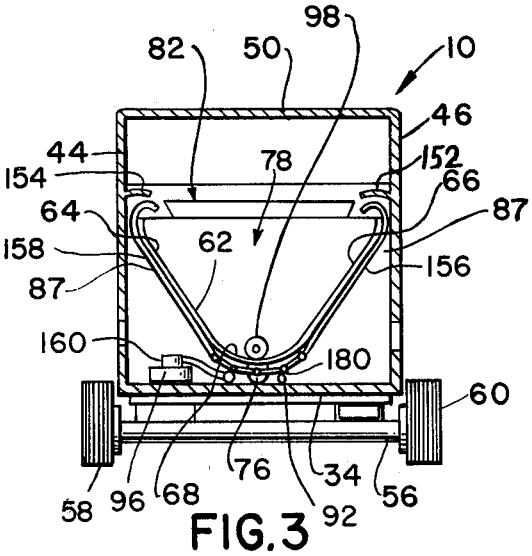
FIG. 3 illustrates an end cross sectional view of the device.
Figure 4:
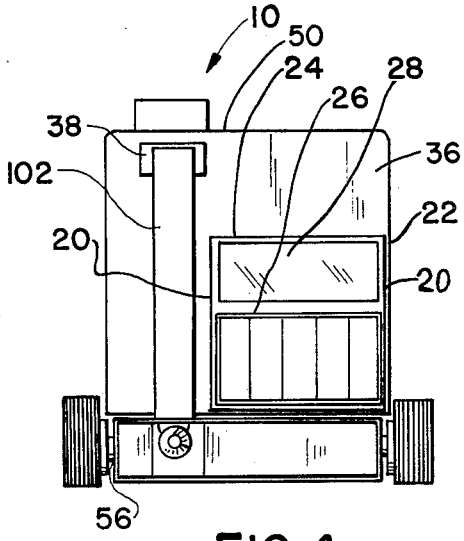
FIG. 4 illustrates a front view of the device.

Turning now descriptively to the drawings, in which similar reference characters denote similar elements throughout the several views, FIGS. 1–4 show a snow removal device 10, which generally comprises a truck unit 11 having a forward cab portion 12 and a rear storage portion 14. The cab portion 12 has a base 16, an upwardly extending rear wall 18, a pair of sidewalls 20 and 22, and a top 24. The cab portion has a forward wall 26 with a window 28 therein. The storage portion 14 has a base 34, an upwardly extending forward wall 36 with an opening 38 therethrough, an upwardly extending rear wall 40 with an opening 42 therethrough, a pair of upwardly extending sidewalls 44, 46, and a top 50 with a raised section 52. The forward cab portion 12 and rear storage portion 14 are joined together at their bases 16 and 34, respectively, by a conventional art jackknife base 54, wherein electrical generator unit 57 is mounted on base 54, located between portions 12, 14. The portions 12, 14 are mounted on three axles 56, wherein each axle 56 has pairs of end wheels 58 and 60. An elongated generally V shaped container 62, having a pair of upwardly extending walls 64, 66, and wherein walls 64, 66 are joined to the interior walls of portion 14, and wherein the base portion 68 of container 62 is curved. Supports, for container 62, are used, but not shown, to provide structural support for the container, by resting same on base 34. The container 62 has a pair of end walls 70, 72 wherein the forward end of the container 62 is disposed higher than the rear end of the container 62 such that base 68 is slanted rearwardly downwardly. A gate drainage valve 74 is disposed in opening 42 in rear wall 40, wherein gate valve 74 is joined by a connecting pipe 76 to the chamber 78 of the container 62, wherein pipe 76 extends through end wall 72 of container 62. A pair of heat deflector shields 80, 82 are disposed in portion 14, wherein shield 80 is mounted on the inner surface of wall 36 and extends over the top of end wall 70, thereby providing space 84, between wall 70 and shield 80. The other shield 82 is mounted on the inner surface of wall 40 thereby forming a second space 86 between wall 72 and shield 82. Side shields 152 and 154 extend between deflector shields 80 and 82, on the sides of rear portion 14, in the interior thereof. A plurality of upstanding heating pipes 87 are disposed on the bottom outer surface of container 62, wherein the pipes 87 are joined together in a grid-like connection and have a heated gaseous medium disposed therein. A plurality of rib-like pipes 156 and 158 extend upwardly on the outside of container 62, so as to reside beneath deflector shields 80, 152 and 154 respectively. Fitting 96, shown residing on wall 46, is connected, by a pipe, to blower device 160, which in turn is coupled to all of rib like pipes 156 and 158, by way of pipes 87. Fitting 99 has an air input port, not shown, which permits air to mix with the vapor fuel. Ignition occurs at port 200, such that hot air travels through pipes 156, 158 and 87, exiting at the free ends of pipes 156 and 158, in a manner well known in the art. An external portable tank, not shown, is coupled to fitting 96 which provides gaseous fuel, by way of pump 160, preferably of the blower variety, into pipes 87 and thence pipes 156 and 158. The open ends of pipes 156 and 158 carrying heated air so as to impinge hot air in the uppermost region of container 62. Pipe 92 is coupled to the network of interconnected pipes 87, providing means of coupling the external vaporized fuel source into the network of pipes 87, the fuel being fed into pipe 92 by way of the free end of pipe 92, accessed through port 48. Opening 48 may be employed through which a flexible hose is coupled to the ends of pipe 92.

A first conveyer screw member 98 is disposed longitudinally in the base 68 of container 62, wherein conveyer screw member 98 is rotatably driven by a first covered, waterproof electrical motor 100 and conveys particles of snow and ice towards the rear of the container 62. An elongated open ended chute member 102 extends through opening 38 of wall 36 of portion 14. The upper end 104 of chute member 102 extends into portion 14 through opening 38 of forward wall 36, wherein the upper end 104 is curved shaped. The lower end 106 of chute member 102, extends downwardly toward the ground, wherein a horizontal extension member 108 is joined to lower open end 106 of chute member 102. The member 108 having an open end 110 rides along the ground as truck unit 10 moves forwardly thereby forcing snow into the member 108. A plurality of vanes 112 are disposed in member 108 for cutting the snow as it enters member 108. A second conveyer screw 114 with associated electrical motor 116 is disposed within chute member 102 to heated container 62, heated by pipes 156 and 158. The snow in container 62 melts and drains outwardly through gate valve 74 onto which is removably secured a flexible hose 118 which may be placed into a storm sewer opening in the road, not shown. A hydraulic assembly 120 is disposed on forward portion 12, wherein assembly 120 is powered by hydraulic generator unit 57. The hydraulic assembly 120 is joined to chute member 102. Chute 102 is pivotally mounted onto portion 12, thereby permitting chute member 102 to be tilted such that member 108 is raised off of the ground, when it is not in use, as shown by dotted lines 108*a* and 102*a*. The upper end of chute member 102 extends into the raised section 52 of top 50, such section 52 being openable, using hinge 180 therefor.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

1. A snow removal device, which comprises:

a. a truck unit having a forward cab portion and a rear storage portion;

b. an elongated V shaped container disposed in said storage unit, said V shaped container having a curved base, a pair of upwardly extending sidewalls, and a pair of upwardly extending end walls, said container being slanted downwardly from a front to a rear of said storage portion;

c. means for injecting snow and ice into said container;

d. a gate valve disposed in said rear storage portion;

e. a connecting pipe joining said container to said gate valve;

f. means for melting said snow in said container comprising a plurality of pipes disposed on an outer surface of said container, said pipes coupled together at one end thereof, at least one gas burner disposed in said rear storage portion, flames of said burner being disposed in said one end of said pipes for heating a gaseous medium within said pipes, heat deflector shields mounted on interior surfaces of the walls of said rear storage portion, said heat deflector shields extending over said side and said end walls of said V shaped container, said heated gaseous medium being directed from the other ends of said plurality of pipes to impinge into the uppermost regions of said V shaped container; and g. means for ejecting a mixture of water formed from said snow and unmelted said snow from said container through said gate valve.

2. A device according to claim 1, wherein said ejecting means further includes a first conveyor screw driven by an electric motor, means for said conveyor screw to transport rearwardly said mixture in said container.

3. A device according to claim 2, wherein said injecting means further includes:

a. an elongated chute member having a pair of open ends, said chute member extending alongside said cab member, said open upper end of said chute member extending into said rear storage unit above said container;

b. a horizontal extension member affixed integrally at an angle to said lower end of said chute member, said chute member having an open end and being adapted to rest on top of the ground, said open end of said extension member adapted to receive said snow therethrough; and c. a second conveyor screw with a second electric drive motor disposed in said chute member said conveyor screw transporting said snow upwardly through said chute member.

4. A device according to claim 3, wherein said extension member has a plurality of vanes disposed therein for cutting said snow.

5. A device according to claim 3, wherein said chute member is pivotally mounted alongside said cab portion, said chute member communicating with a hydraulic system within said cab for tilting said lower end of said chute member upwardly and downwardly.

* * * * *